US005545032A

United States Patent [19]

Jansohn et al.

[11] Patent Number: 5,545,032

[45] Date of Patent: Aug. 13, 1996

[54] METHOD OF OPERATING A FIRING INSTALLATION

[75] Inventors: Peter Jansohn, Küssaberg; Tino-Martin Marling, Uhlingen-Birkendorf, both of Germany; Thomas Sattelmayer, Mandach, Switzerland

[73] Assignee: ABB Research Ltd., Zurich, Switzerland

[21] Appl. No.: 439,241

[22] Filed: May 11, 1995

[30] Foreign Application Priority Data

Jun. 28, 1994 [DE] Germany ..... 44 22 535.0

[51] Int. Cl.[6] ..... F23M 3/00

[52] U.S. Cl. ..... 431/9; 431/115

[58] Field of Search ..... 431/9, 115, 116; 600/39, 52

[56] References Cited

U.S. PATENT DOCUMENTS 5,044,935 9/1991 Peter ..... 431/9
5,118,283 6/1992 Sattelmayer ..... 431/9
5,127,821 7/1992 Keller ..... 431/115
5,201,650 4/1993 Johnson ..... 431/115
5,423,674 6/1995 Knopfel et al. ..... 431/115

*Primary Examiner*—Carroll B. Dority
*Attorney, Agent, or Firm*—Burns, Doane, Swecker & Mathis

[57] ABSTRACT

In a firing installation which is designed to minimize the pollutant emissions during the use of both a liquid and a gaseous fuel, an annular chamber (12) is arranged downstream of a first combustion stage (1) on the head side of a second combustion stage (2) arranged downstream. The first combustion stage (1) is operated as a lean stage with a burner (100), while the second combustion stage (2) is operated as a near-stiochiometric stage. The wall of the annular chamber (12) has a number of openings (13) for the inflow of a mixture (14) of recycled flue gas (4) and fuel (15). The combustion air (115) for the burner (100) is likewise a mixture (6) of air (3) and recycled flue gas (4). The hot gases from this first combustion stage (1) are moderated before entering the second combustion stage (2), self-igniting combustion taking place in this second combustion stage (2) starting from the annular chamber (12).

9 Claims, 4 Drawing Sheets

107
122
115
110b
110a
106
V
V
101
110
117
116
116
105
IV
IV
114
102
115
104
115
100
109
III
III
108
102a
101a
119
113
113
103
112
121a

METHOD OF OPERATING A FIRING INSTALLATION

FIELD OF THE INVENTION

The present invention relates to a method for operating a firing installation for a boiler. It also relates to a firing installation for carrying out the method.

DISCUSSION OF BACKGROUND

In firing installations of conventional type of construction, the fuel is injected into a combustion space via a nozzle and burned there with the addition of combustion air. In principle, the operation of such firing installations is possible with a gaseous and/or liquid fuel. When a liquid fuel is used, the weak point with respect to clean combustion in relation to $NO_x$, CO and UHC emissions (UHC=unsaturated hydrocarbons) primarily lies in the fact that the atomization of the fuel must attain a high degree of mixing (gasification) with the combustion air. When a gaseous fuel is used, the combustion therefore takes place with a substantial reduction in the pollutant emissions. However, in firing installations for heating boilers, gas-operated burners, despite the many advantages, have not really been able to prevail. The reason for this may be that the logistics for gaseous fuels necessitate an infrastructure expensive per se. If the operation of firing installations with liquid fuel is therefore provided, the quality of the combustion with regard to low pollutant emissions is heavily dependent upon whether success is achieved in providing an optimum degree of mixing between fuel and combustion air, i.e. whether complete gasification of the liquid fuel is guaranteed. The use of a premixing section, which acts upstream of the actual burner head, has not achieved the goal, for it must always be feared in the case of such a configuration that a flashback of the flame into the interior of the premixing zone can take place. It is admittedly true that premixing burners have been disclosed which work with 100% excess air, so that the flame can be operated shortly before the point of extinction. Here, however, it has to be taken into consideration that excess air of 15% at most is permissible in firing installations on account of the boiler efficiency, which is why the use of such burners in atmospheric firing installations does not guarantee optimum operation. Furthermore, even if the requisite degree of gasification of the liquid fuel could approximately be achieved, there would still be no effect on the high flame temperatures, which are known to be responsible for the formation of $NO_x$ emissions. The desired combustion at low flame temperatures as well as with a homogeneous fuel/air mixture cannot be achieved with the means which have been disclosed by the prior art.

SUMMARY OF THE INVENTION

Accordingly, one object of the invention, in a method and a firing installation of the type mentioned at the beginning, is to minimize the pollutant emissions, in particular the $NO_x$ emissions, during the use of both a liquid fuel and a gaseous fuel as well as during mixed operation with the said fuels.

The idea behind the invention differs from the conventional principles in that the staging is carried out solely in the excess-air zone by a twofold addition of fuel and with recirculated flue-gas. In the first stage, the combustion air is fed via a heat exchanger to an aerodynamically stabilized premixing burner. Depending on the design of the heat exchanger, the combustion air can be preheated up to about 400° C., which during the combustion of oil leads to very effective pre-evaporation. The combustion-air ratio in this so-called lean stage is around 2.1, corresponding to about 11% residual oxygen, as a result of which the $NO_x$ emissions, in the atmospheric case, are below 1 vppm at flame temperatures of about 1300° C. On the way to the second stage, heat is extracted from the medium so that, upon entry to the second stage, the temperature is still about 1000° C. Further fuel/flue-gas mixture is injected there in an axially offset manner, preferably via an annular chamber, until a residual-oxygen content of about 3% in the exhaust gas is achieved. The injected mixture is ignited in the process by the hot flue gases from the first stage. Complete burn-up subsequently takes place in the combustion space at a temperature of about 1400° C.

The essential advantage of the invention can be seen in the fact that the arrangement of the injection openings for the fuel/flue-gas mixture control a time shift of the ignition in the combustion chamber and thus influence the oxygen content during complete burn-up in such a way that, when the system is optimally trimmed, the expected $NO_x$ emissions at complete burn-up are between 5–8 vppm. According to the current level of knowledge, this value marks the theoretical lower limit during the near-stoichiometric combustion of fossil fuels.

A further advantage of the invention can be seen in the fact that thermally conditioned flue gas can be fed to the combustion air of the first stage in order to influence the preheating temperature on the one hand and to be able to further reduce the residual-oxygen content after the second stage when required on the other hand.

Advantageous and convenient further developments of the achievement of the object according to the invention are defined in the further claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
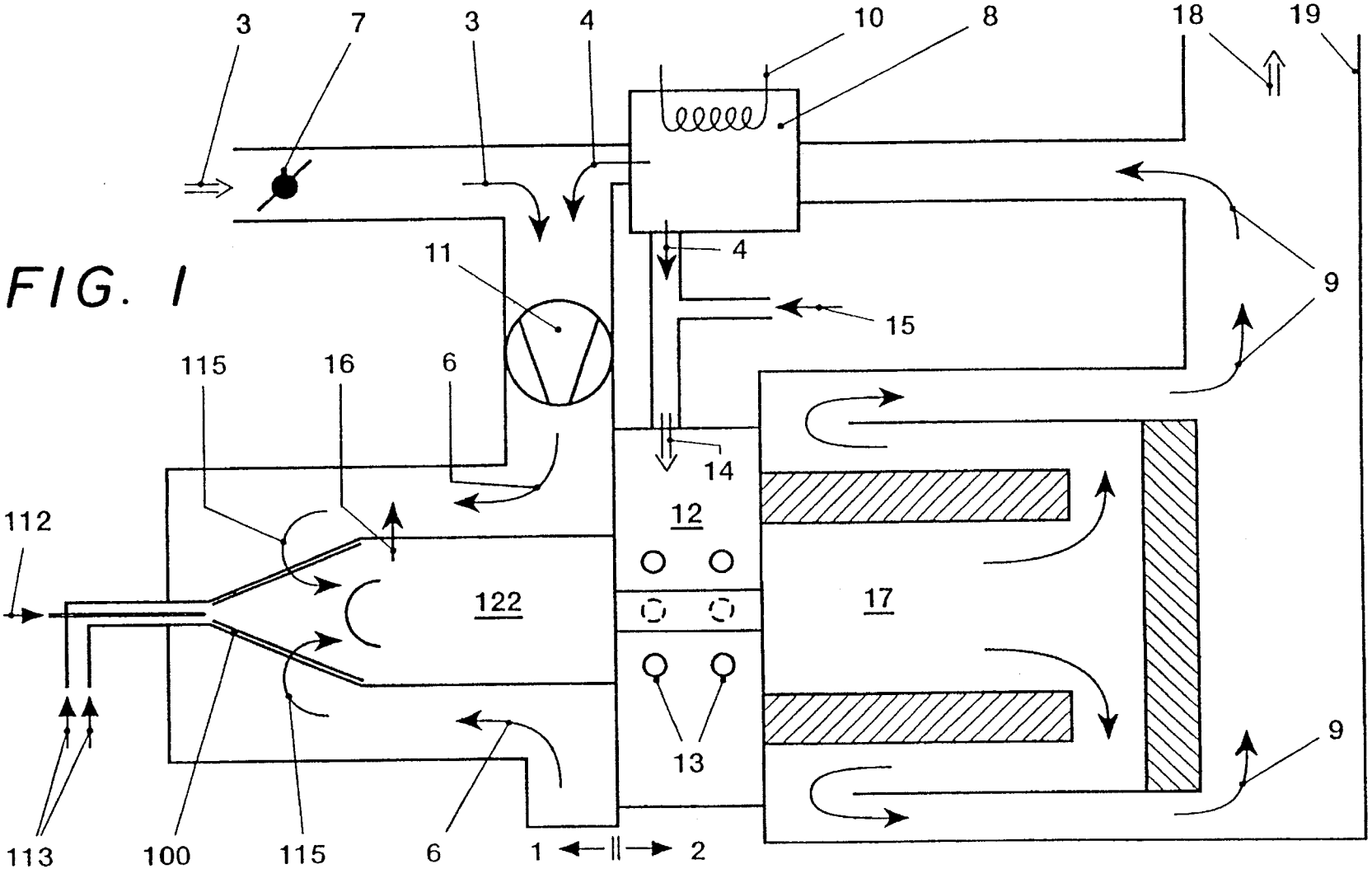
FIG. 1 is a schematic representation of a boiler installation for combustion in stages.

Referring now to the drawings, wherein like reference numerals designate identical or corresponding parts throughout the several views, all elements not necessary for directly understanding the invention have been omitted, and the direction of flow of the various media is indicated by arrows, FIG. 1 shows a boiler installation which is subdivided into a lean stage 1 and a near-stoichiometric stage 2. The lean stage 1 essentially consists of a premixing burner 100 having a downstream combustion space 122 in which a flame temperature of about 1300° C. prevails. The premixing burner 100 is operated with a liquid 112 and/or gaseous fuel 113. The combustion air 115 for the premixing burner 100 is a mixture 6 which is composed of fresh air 3 and of recycled, thermally conditioned flue gas 4. The degree of mixing is maintained on the air side by a controllable butterfly valve 7, this air 3 occurring in an unconditioned manner, that is, at ambient temperature. The flue gas 4 comes from a flue-gas distributor 8, which originates from the flue gases 9 from the near-stoichiometric stage 2. These flue gases 9 occur at a temperature of about 300° C. and they are cooled down to about 260° C. in the said flue-gas distributor 8 by a heat-exchange system 10. These cooled flue gases 4 and the fresh air 3 are mixed upstream of the premixing burner 100 and are compressed in a compressor 11 acting there, the temperature of this compressed air/flue-gas mixture being about 260° C. This mixture 6 is then further processed thermally by a further heat exchange, induced by the wall of the combustion space 122 and symbolized by arrow 16, in such a way that the combustion air 115 for the premixing burner 100 flows in there at about 400° C. Located on the downstream side of the combustion space 122 is an annular chamber 12 which already belongs to the near-stoichiometric stage 2. Flowing into this annular chamber 12 are the slightly cooled hot gases from the lean stage 1, which is operated with combustion air 115 at about 11% $O_2$, as a result which the $NO_x$ emissions in the atmospheric case are below 1 vppm at a flame temperature of about 1300° C. Furthermore, this annular chamber 12 is perforated with a number of injection holes 13 through which a fuel/flue-gas mixture 14 flows in. This mixture 14 is composed of a portion of flue gas 4 from the flue-gas distributor 8 and of a further portion of fuel 15, which is preferably a gaseous fuel. On the way to the near-stoichiometric stage 2, the hot gases prepared in the lean stage 1 have heat extracted from them by the heat exchange 16 already mentioned, so that a temperature of about 1000° C. still prevails upon entering the annular chamber 12. The fuel/flue-gas mixture 14 injected by axial displacement into the annular chamber 12 reduces the residual oxygen content of the conditioned hot gases from the lean stage 1 down to about 3%. Furthermore, the mixture 14 injected in the annular chamber 12 is self-ignited by the hot gases of about 1000° C., complete burn-up subsequently taking place in the boiler furnace 17 at a temperature of about 1400° C. After leaving the boiler furnace 17, the flue gases 9 still have a temperature of about 300° C., a portion thereof, as already explained above, being directed into the flue-gas distributor 8. The flue gases 18 which are not diverted are discharged at the lowest temperature into the open via a chimney 19. During optimum control of the various media, which induce complete burn-up inside the near-stoichiometric stage 2, the expected $NO_x$ emissions are between 5–8 vppm, which according to the present level of knowledge represents a lower limit during the near-stoichiometric combustion of fossil fuels.

Figure 2:
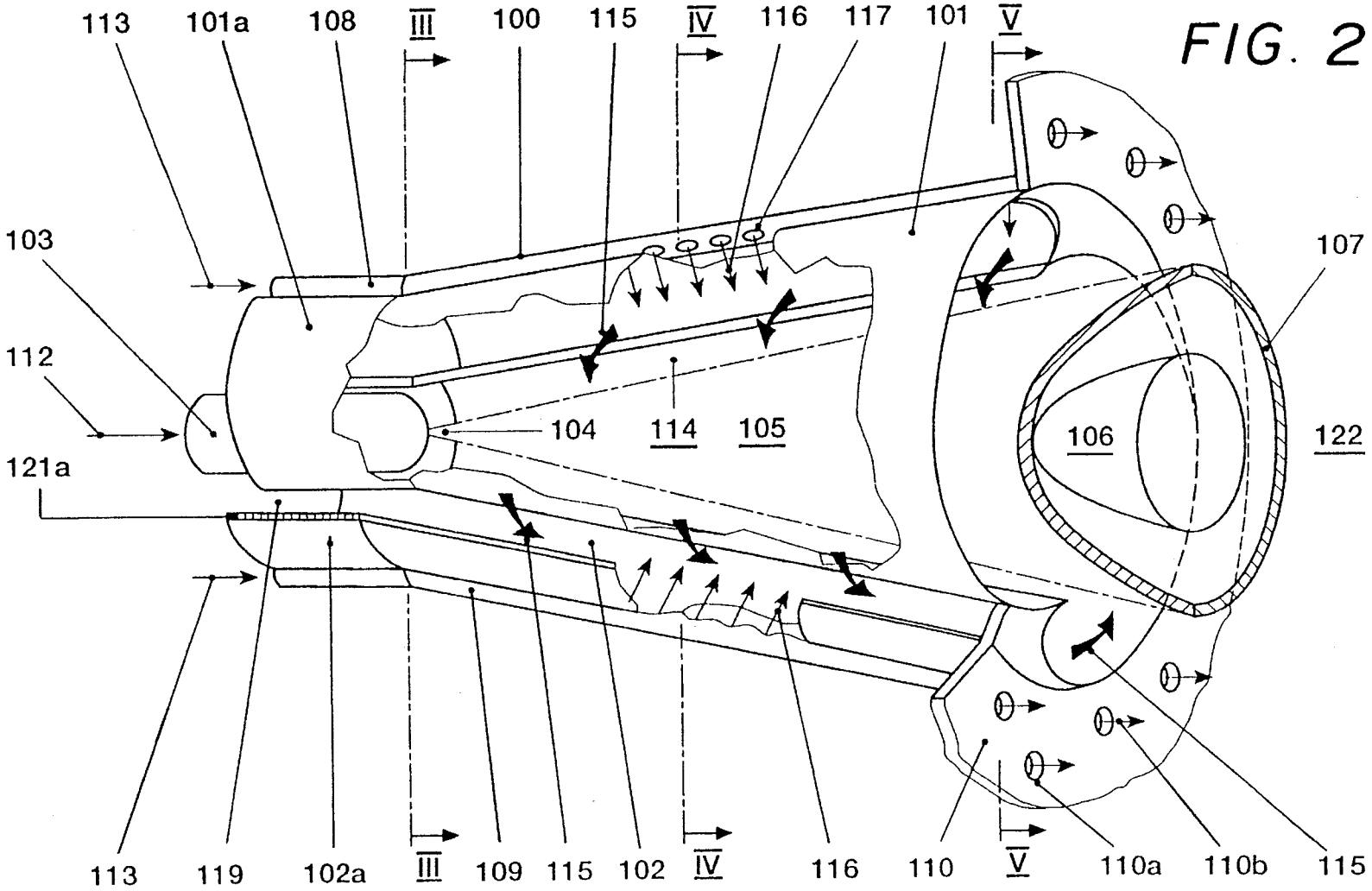
FIG. 2 shows a premixing burner in the embodiment as a "double-cone burner" in perspective representation, in appropriate cut-away section.
Figure 3:
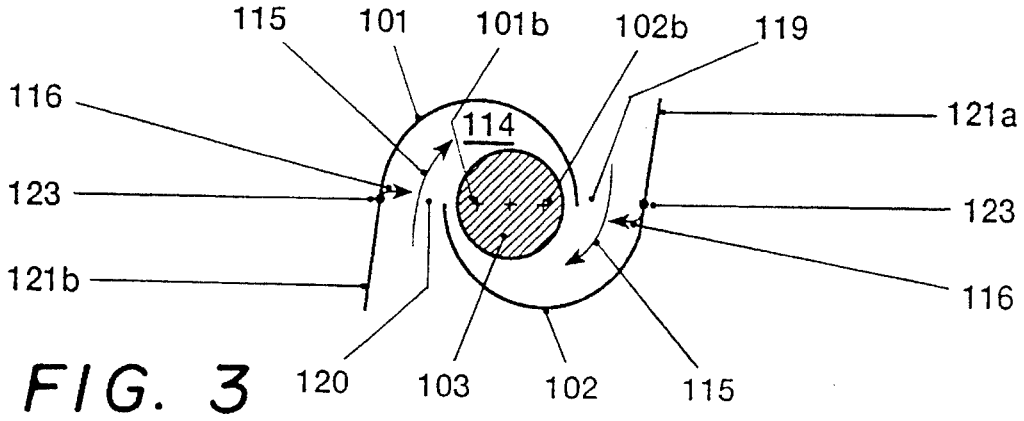
FIGS. 3–5 show corresponding sections through various planes of the premixing burner according to FIG. 2, and FIGS. 6 and 7 illustrate burners shaped with increasing conicity (trumpet shape) and decreasing conicity (tulip shape) respectively.
Figure 4:
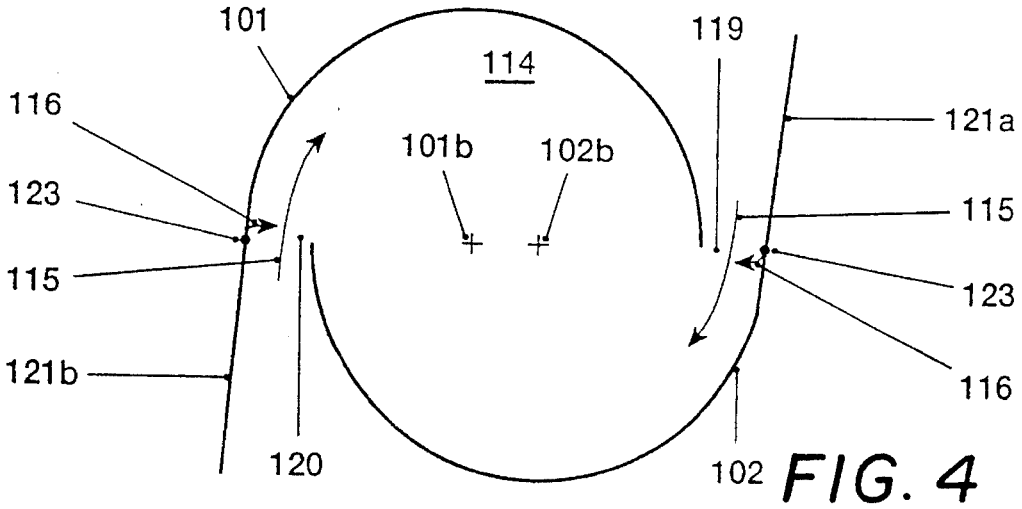
Figure 5:
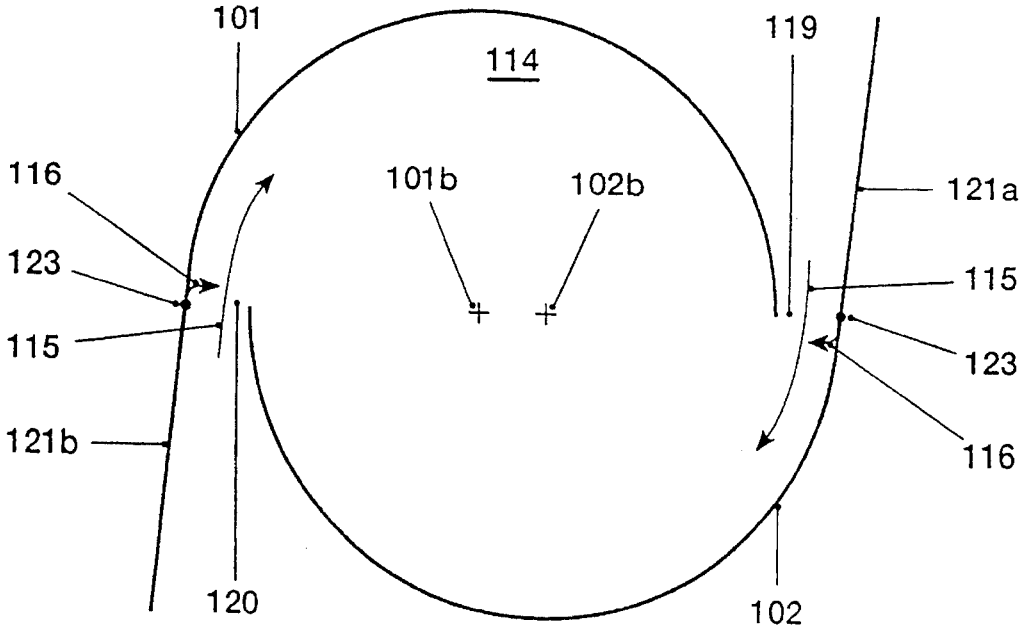

In order to better understand the construction of the premixing burner 100, it is of advantage if the individual sections according to FIGS. 3–5 are used at the same time as FIG. 2. Furthermore, in order to avoid making FIG. 2 unnecessarily complicated, the baffle plates 121*a*, 121*b* shown schematically according to FIGS. 3–5 are only indicated in FIG. 2.

The description of FIG. 2 below also makes reference to the remaining FIGS. 3–5 when required.

Figure 6:
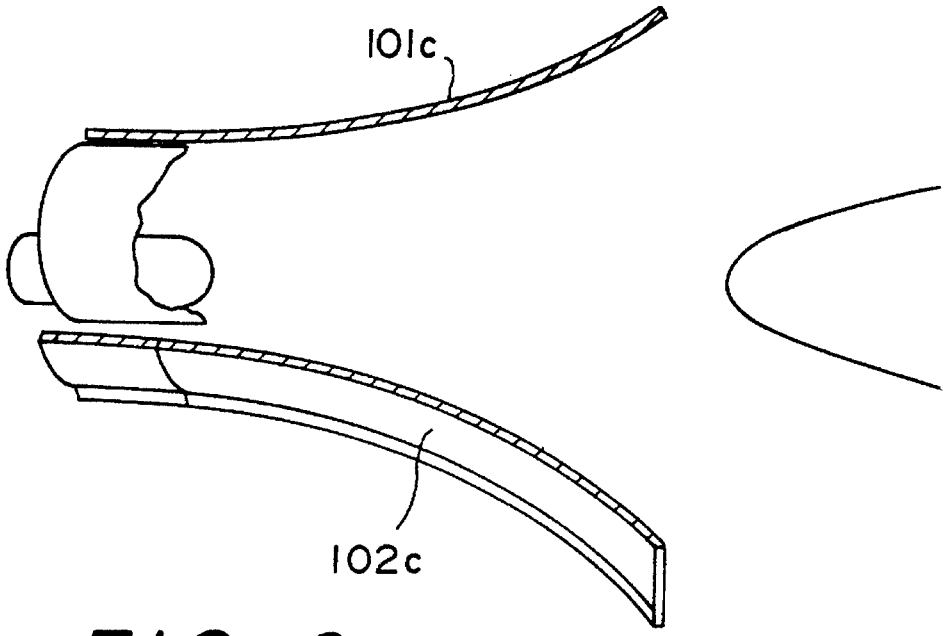
Figure 7:
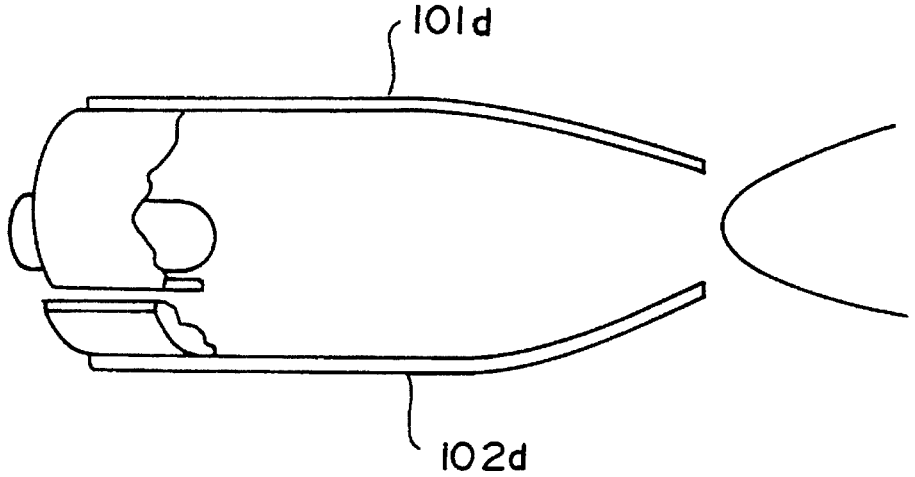

The premixing burner 100 according to FIG. 2 consists of two hollow conical sectional bodies 101, 102 which are nested in a mutually offset manner. The mutual offset of the respective centre axis or longitudinal symmetry axis 101*b*, 102*b* of the conical sectional bodies 101, 102 provides on both sides, in mirror-image arrangement, one tangential air-inlet slot 119, 120 each (FIGS. 3–5) through which the combustion air 115 flows into the interior space of the premixing burner 100, i.e. into the conical hollow space 114. The conical shape of the sectional bodies 101, 102 shown has a certain fixed angle in the direction of flow. Of course, depending on the operational use, the sectional bodies 101, 102 can have increasing or decreasing conicity in the direction of flow as shown at 101*c* and 102*c* in FIG. 6 and at 101*d* and 102*d* in FIG. 7, respectively, and as shown and mentioned in U.S. Pat. No. 5,274,993, similar to a trumpet or tulip. The two conical sectional bodies 101, 102 each have a cylindrical initial part 101*a*, 102*a*, which likewise run offset from one another in a manner analogous to the conical sectional bodies 101, 102 so that the tangential air-inlet slots 119, 120 are present over the entire length of the premixing burner 100. Accommodated in the region of the cylindrical initial part is a nozzle 103, the fuel injection 104 of which coincides approximately with the narrowest cross section of the conical hollow space 114 formed by the conical sectional bodies 101, 102. The injection capacity of this nozzle 103 and its type depend on the predetermined parameters of the respective premixing burner 100. It is of course possible for the premixing burner to be embodied purely conically, that is, without cylindrical initial parts 101*a*, 102*a*. Furthermore, the conical sectional bodies 101, 102 each have a fuel line 108, 109, which are arranged along the tangential inlet slots 119, 120 and are provided with injection openings 117 through which preferably a gaseous fuel 113 is injected into the combustion air 115 flowing through there, as the arrows 116 are intended to symbolize. These fuel lines 108, 109 are preferably positioned at the latest at the end of the tangential inflow, before entering the conical hollow space 114, in order to obtain optimum air/fuel mixing. On the combustion-space side 122, the outlet opening of the premixing burner 100 merges into a front wall 110 in which there are a number of bores 110*a*. The latter come into operation when required and ensure that diluent air or cooling air 110*b* is fed to the front part of the combustion space 122. In addition, this air feed provides for flame stabilization at the outlet of the premixing burner 100. This flame stabilization becomes important when it is a matter of supporting the compactness of the flame as a result of radial flattening. The fuel fed through the nozzle 103 is a liquid fuel 112, which if need be can be enriched with a recycled exhaust gas. This fuel 112 is injected at an acute angle into the conical hollow space 114. Thus a conical fuel profile 105 forms from the nozzle 103, which fuel profile 105 is enclosed by the rotating combustion air 115 flowing in tangentially. The concentration of the fuel 112 is continuously reduced in the axial direction by the inflowing combustion air 115 to form optimum mixing. If the premixing burner 100 is operated with a gaseous fuel 113, this preferably takes place via opening nozzles 117, the forming of this fuel/air mixture being achieved directly at the end of the air-inlet slots 119, 120. When the fuel 112 is injected via the nozzle 103, the optimum, homogeneous fuel concentration over the cross section is achieved in the region of the vortex breakdown, that is, in the region of the backflow zone 106 at the end of the premixing burner 100. The ignition is effected at the tip of the backflow zone 106. Only at this point can a stable flame front 107 develop. A flashback of the flame into the interior of the premixing burner 100, as is potentially the case in known premixing sections, attempts to combat which are made with complicated flame retention baffles, need not be feared here. If the combustion air 115 is additionally preheated or enriched with recycled exhaust gas, this provides lasting assistance for the evaporation of the liquid fuel 112 before the combustion zone is reached. The same considerations also apply if liquid fuels are supplied via the lines 108, 109 instead of gaseous fuels. Narrow limits are to be adhered to in the configuration of the conical sectional bodies 101, 102 with regard to cone angle and width of the tangential air-inlet slots 119, 120 so that the desired flow field of the combustion air 115 can arise with the flow zone 106 at the outlet of the premixing burner 100. In general it may be said that a reduction in the cross section of the tangential air-inlet slots 119, 120 displaces the backflow zone 106 further upstream, although this would then result in the mixture being ignited earlier. Nonetheless, it can be stated that the backflow zone 106, once it is fixed, is positionally stable per se, since the swirl coefficient increases in the direction of flow in the region of the conical shape of the premixing burner 100. The axial velocity inside the premixing burner 100 can be changed by a corresponding feed (not shown) of an axial combustion-air flow. Furthermore, the construction of the premixing burner 100 is especially suitable for changing the size of the tangential air-inlet slots 119, 120, whereby a relatively large operational range can be covered without changing the overall length of the premixing burner 100.

The geometric configuration of the baffle plates 121*a*, 121*b* is now apparent from FIGS. 3–5. They have a flow-initiating function, extending, in accordance with their length, the respective end of the conical sectional bodies 101, 102 in the oncoming-flow direction relative to the combustion air 115. The channeling of the combustion air 115 into the conical hollow space 114 can be optimized by opening or closing the baffle plates 121*a*, 121*b* about a pivot 123 placed in the region of the inlet of this duct into the conical hollow space 114, and this is especially necessary if the original gap size of the tangential air-inlet slots 119, 120 is changed. These dynamic measures can of course also be provided statically by baffle plates forming as and when required a fixed integral part with the conical sectional bodies 101, 102. The premixing burner 100 can likewise also be operated without baffle plates or other aids can be provided for this.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States if:

1. A method of operating a firing installation, which includes a first combustion stage having at least a burner and a second combustion stage arranged downstream of the first combustion stage, the method comprising the steps of:

forming a mixture of air and recycled flue gas for combustion air for the first combustion stage and introducing the mixture into the burner;

cooling hot gases from the first combustion stage before the hot gases flow into the second combustion stage, the cooled gases retaining a temperature greater than an ignition temperature of a fuel for the second combustion stage;

forming a mixture of fuel and recycled flue gas and introducing the mixture to a head side of the second combustion stage into the hot gases from the first combustion stage;

wherein combustion is initiated in the second combustion stage by self-ignition; and, recycling a portion of flue gases from the second stage and cooling the recycled flue gases before mixing in the first and second stages.

2. The method as claimed in claim 1, wherein the first combustion stage is operated as a lean stage with an oxygen content of 9–13%, and wherein the second combustion stage is operated as a near-stoichiometric stage with an oxygen content of 2–4%.

3. A firing installation comprising:

a first combustion stage comprising at least a burner and an enclosure defining a combustion space downstream of the burner;

a second combustion stage arranged downstream of the first combustion stage and comprising at least an annular combustion chamber downstream of the first combustion stage and an enclosed space downstream of the annular combustion chamber;

means for recycling and cooling a portion of flue gas from the second combustion stage;

means for producing a mixture of the recycled and cooled flue gas and fuel, wherein a wall of the annular combustion chamber has openings for injecting the mixture of recycled flue gas and fuel; and a compressor to compress combustion air for the burner.

4. The firing installation as claimed in claim 3, wherein the burner comprises at least two hollow, conical sectional bodies nested one inside the other in a direction of flow to define a conical interior space and whose respective longitudinal symmetry axes run mutually offset, wherein adjacent walls of the nested sectional bodies form ducts for a tangential flow of combustion air into the interior space, the ducts extending longitudinally, and at least one fuel nozzle in the conical interior space formed by the sectional bodies.

5. The device as claimed in claim 4, wherein further fuel nozzles are disposed in a region of the tangential combustion air ducts along the longitudinal extent.

6. The device as claimed in claim 4, wherein the sectional bodies are shaped to widen conically at a fixed angle in the direction of flow.

7. The device as claimed in claim 4, wherein the sectional bodies are shaped to have increasing conicity in the direction of flow.

8. The device as claimed in claim 4, wherein the sectional bodies are shaped to have decreasing conicity in the direction of flow.

9. The device as claimed in claim 3, further comprising means for cooling hot gases from the first combustion stage before the hot gases are introduced into the second combustion stage, so that the cooled gases having a temperature greater than an ignition temperature of a fuel for the second combustion stage.

* * * * *